US011220361B2

(12) United States Patent
Fahey et al.

(10) Patent No.: US 11,220,361 B2
(45) Date of Patent: Jan. 11, 2022

(54) PACKAGING APPARATUS FOR HANDLING PILLS AND ASSOCIATED METHOD

(71) Applicant: Aylward Enterprises, LLC, New Bern, NC (US)

(72) Inventors: Jonathan Fahey, New Bern, NC (US); Vincent Holley, Greenville, NC (US); Jeffrey Burkett, Kinston, NC (US); James Terwilliger, New Bern, NC (US)

(73) Assignee: Aylward Enterprises, LLC, New Bern, NC (US)

( * ) Notice: Subject to any disclaimer, the term of this patent is extended or adjusted under 35 U.S.C. 154(b) by 135 days.

(21) Appl. No.: 16/653,547

(22) Filed: Oct. 15, 2019

(65) Prior Publication Data

US 2020/0115088 A1 Apr. 16, 2020

Related U.S. Application Data

(60) Provisional application No. 62/744,677, filed on Oct. 12, 2018.

(51) Int. Cl.
*B65B 5/10* (2006.01)
*B65B 57/14* (2006.01)
(Continued)

(52) U.S. Cl.
CPC ..... *B65B 5/103* (2013.01); *B65B 35/08* (2013.01); *B65B 57/14* (2013.01); *B65B 57/20* (2013.01); *B65B 35/46* (2013.01); *B65B 37/08* (2013.01)

(58) Field of Classification Search
CPC .. B65B 1/10; B65B 1/16; B65B 5/103; B65B 35/08; B65B 35/26; B65B 35/28;
(Continued)

(56) References Cited

U.S. PATENT DOCUMENTS 422,364 A 3/1890 Bateson
792,918 A 6/1905 Ohlendorf et al.
(Continued)

FOREIGN PATENT DOCUMENTS

CA 2203856 10/1998
WO 94/15859 7/1994
(Continued)

*Primary Examiner* — Stephen F. Gerrity
(74) *Attorney, Agent, or Firm* — Ward and Smith, P.A.; Ryan K. Simmons

(57) ABSTRACT

A packaging apparatus and method for depositing pills into a series of containers is provided. A cylindrical rotary slat is rotatable about a first axis and comprises radially inward and outward portions, the radially outward portion defining pill apertures for receiving pills therein at a first angular position. A negative pressure system is configured to apply a negative pressure to the pill apertures to retain the pills therein. Two ejection devices are in communication with the pill apertures at a second angular position and a third angular position of the rotary slat to eject the respective pills outwardly from the pill apertures. A plurality of collection mechanisms is disposed adjacent to the radially outward portion about the second and third angular positions, and is configured to collect the pills ejected from the pill apertures and to direct the pills toward the respective series of containers for deposition therein.

20 Claims, 11 Drawing Sheets

(51) Int. Cl.

| | |
|---|---|
| ***B65B 57/20*** | (2006.01) |
| ***B65B 35/08*** | (2006.01) |
| *B65B 37/08* | (2006.01) |
| *B65B 35/46* | (2006.01) |

(58) Field of Classification Search
CPC ..... B65B 35/46; B65B 35/48; B65B 37/08; B65B 37/14; B65B 57/14; B65B 57/20
USPC ..... 53/54, 495, 498, 499, 500, 501
See application file for complete search history.

(56) References Cited

U.S. PATENT DOCUMENTS 1,383,623 A 7/1921 Groves
1,775,141 A 9/1930 Risser
1,824,432 A 9/1931 Hendry
1,839,327 A 1/1932 Mayo
2,094,460 A 9/1937 McBean et al.
2,479,667 A 8/1949 Boylan
2,585,558 A 2/1952 Lakso
2,742,184 A 4/1956 Yerkes et al.
2,845,759 A 8/1958 Cote et al.
3,028,713 A 4/1962 Kennedy et al.
3,139,713 A 7/1964 Merrill et al.
3,206,062 A 9/1965 Rappaport
3,225,513 A 12/1965 Ehe
3,354,607 A 11/1967 Lakso
3,387,695 A 6/1968 Hendrickson
3,412,908 A 11/1968 Ferrault
3,417,542 A 12/1968 Merrill et al.
3,677,437 A 7/1972 Haigler
3,722,740 A 3/1973 List
3,782,590 A 1/1974 Apfel
3,796,346 A 3/1974 Ribouleau
3,837,139 A 9/1974 Roseberg
3,925,960 A 12/1975 Saari et al.
3,979,878 A 9/1976 Berney
3,986,636 A 10/1976 Hoppmann et al.
4,017,003 A 4/1977 Heino
4,047,637 A 9/1977 Grunstad et al.
4,094,129 A * 6/1978 List ..... A61J 7/02 198/418
4,094,439 A 6/1978 List
4,154,681 A 5/1979 Shields et al.
4,231,462 A 11/1980 Ackley et al.
4,265,072 A 5/1981 Egli
4,308,942 A 1/1982 Ackley
4,449,642 A 5/1984 Dooley
4,500,012 A * 2/1985 Ackley ..... A61J 3/074 221/173
4,674,259 A 6/1987 Hills
4,677,283 A 6/1987 Lewis
4,697,721 A 10/1987 Johnson et al.
5,085,510 A * 2/1992 Mitchell ..... B07C 5/3422 209/577
5,463,839 A 11/1995 Stange et al.
5,515,668 A 5/1996 Hunt et al.
5,638,657 A 6/1997 Archer et al.
5,787,825 A 8/1998 Yaji et al.
6,185,901 B1 2/2001 Aylward
6,266,946 B1 7/2001 Aylward
6,269,612 B1 8/2001 Aylward
6,401,429 B2 6/2002 Aylward
6,422,418 B1 7/2002 Collins et al.
6,505,460 B2 1/2003 Aylward
6,561,377 B1 5/2003 Pearson et al.
6,631,826 B2 10/2003 Pollard et al.
6,681,550 B1 1/2004 Aylward
6,741,731 B1 * 5/2004 Yamamoto et al. ..... G01N 21/9508 382/141
6,799,413 B2 10/2004 Aylward
7,255,247 B2 * 8/2007 Aylward ..... B65B 35/08 221/168
7,299,606 B2 11/2007 Bonatti et al.
8,424,274 B2 * 4/2013 Aylward et al. ..... B65B 37/08 53/473
2001/0045081 A1 11/2001 Aylward
2004/0011806 A1 * 1/2004 Luciano et al. ..... B65B 35/08 221/266
2004/0128955 A1 7/2004 Aylward
2005/0217208 A1 * 10/2005 Cicognani ..... B65B 5/08 53/54
2006/0006190 A1 1/2006 Janet et al.
2006/0180234 A1 8/2006 Aylward
2006/0201781 A1 9/2006 Kodera
2007/0289660 A1 * 12/2007 Aylward ..... B65B 35/08 141/18
2009/0044495 A1 2/2009 Aylward
2009/0094947 A1 4/2009 Aylward
2014/0123601 A1 * 5/2014 Murokh ..... B65B 57/00 53/52
2015/0239585 A1 * 8/2015 Weigel et al. ..... B65B 5/103 222/1
2021/0086934 A1 * 3/2021 Burkett, Jr. et al. .... B65B 59/04

FOREIGN PATENT DOCUMENTS

WO 03/097459 A 11/2003
WO 2006/018142 A1 2/2006

* cited by examiner

PACKAGING APPARATUS FOR HANDLING PILLS AND ASSOCIATED METHOD

CROSS-REFERENCE TO RELATED APPLICATIONS

This patent application claims priority from provisional Patent Application Ser. No. 62/744,677, filed Oct. 12, 2018, which is incorporated herein by reference in its entirety.

BACKGROUND OF THE INVENTION

Field of the Invention

Embodiments of the present invention relate to packaging machines and, more particularly, to an automated packaging machine for filling containers with pills, and associated method.

Description of Related Art

Pharmaceutical medicines and associated packaging apparatus are typically subject to relatively strict consumer protection guidelines. For example, pills, capsules, and the like, must be produced and packaged in such a way as to at least meet the minimum sterility requirements mandated by federal regulations. In addition, the pills should be delivered into the packaging such that the contents accurately meet the claimed labeling "count", i.e., each package includes exactly the predetermined number of pills. Notwithstanding the above, it is also desired to package the product in a mass production operation to offset costs typically attributed to a labor intensive operation in order to provide an economic product.

In the past, pill filling machines have been proposed that provide automated bottle counts by filling a hopper with pills and causing a plurality of the pills to be caught by a pill capturing device, such as an array of rotary slats. The rotary slats drop the captured pills into a plurality of bottles disposed in alignment with the dropping pills. The bottles are distributed along an endless conveyor belt that is timed to advance and stop the bottles according to the filling operation.

Conventional pill capturing devices more particularly include a series of rotary slats each configured to receive, hold, and move a plurality of capsules or pills along a closed path. The rotary slats are typically discs fixed on a rotatable shaft and have a plurality of openings in the outer peripheral edge portion thereof for capturing individual pills. Accordingly, the closed path is arcuate and generally disposed between a pill hopper and discharge area above the conveyor belt. By the rotary action of the slat, the pills move in a direction normal to the conveyor belt. The pill capturing device then generally discharges the pills by rotating the slats, which move corresponding to the closed path, such that the pills fall out of the respective openings at the filling station. The pills are often funneled through a chute that empties into a corresponding bottle.

The "count," or number of pills in the bottle, is determined by positioning the bottles in the pill dropping zone for a predetermined time. The duration of the filling operation for each bottle corresponds to the number of openings in each slat that the machine is capable of delivering to the bottles per unit of time. The duration of the filling operation, speed of the rotary slats, and configuration of the pill capturing device are used to calculate the count.

Unfortunately, if the pill capturing device fails to capture a pill in each and every cavity or receptacle, or if a pill should mistakenly be diverted, at least one of the bottles can be improperly filled. The conventional solution to this problem is to situate an operator adjacent to the slats to ensure that each receptacle is filled with a pill. If a pill is missing, the operator manually places a pill in the receptacle. Such an approach involves labor costs and can be unsatisfactory for sterility purposes. In addition, the accuracy of the count of each bottle is largely determined by the operator and, as such, a fully and consistently accurate count cannot be guaranteed.

U.S. Pat. No. 6,185,901 to Aylward, which is incorporated herein by reference, provides an exemplary solution to this problem by way of a machine with independently driven rotary slats. The pills are allowed to fall into an exterior receptacle of a rotary slat and, in one embodiment, passed under a rotary brush in an attempt to prevent two pills from being disposed in the same receptacle. A separate counting device is associated with each rotary slat for counting each pill as it falls from the slat into the container. A positive count is provided for each container and improperly filled slats will not affect the total count for that container. If a particular container has a low count, the respective slat can be further rotated to fill the container. Because the slats are independently driven, the other slats can remain stationary to prevent overfilling. Thus, the machine permits an accurate filling of each bottle.

One alternative apparatus is a rotatable drum, as provided in U.S. Pat. No. 4,094,439 to List. The rotatable drum includes a plurality of parallel rows of throughgoing holes that constitute receptacles for dragees. The dragees enter the receptacles in the drum from the interior of the drum at an inner input location, exit to the exterior of the drum at an outer retrieval location, and are filled into bottles. An ordering device facilitates the entry of the dragees into the receptacles, and feeler blades engage the receptacles. If any of the receptacles in an axially extending row do not contain a dragee, one of the feeler blades actuates a bolt pusher, which prevents any of the dragees in the row from being filled into the bottles. Instead, a solenoid and knockout bar empty the receptacles of the row. By preventing the bottles to be filled from partially filled rows of receptacles, the apparatus prevents the different bottles from being filled at different rates.

Further, U.S. Pat. No. 8,424,274 to Aylward, which is incorporated herein by reference, provides a similar rotary drum apparatus wherein the outward portion of the drum is defined by a plurality of pill apertures, each adapted to receive a pill from the pill containment area outside the drum. The pills fill the open apertures around the rotating drum and are retained in the respective apertures using suction from a negative pressure system inside the drum. An ejection device is configured at a rotationally angular position inside the rotary drum to be in communication with the pill apertures. When an aperture of the rotary drum containing the pill reaches the rotationally angular position corresponding to that of the ejection device, the ejection device is engaged so as to eject the respective pill from the pill aperture outward into a collection mechanism. The pill is collected in the collection mechanism and diverted into the pill bottle.

Undesirably, this configuration provides no solution for efficiently handling pills that are broken or defective. Broken or defective pills must be individually and affirmatively selected or otherwise independently targeted for release, a process which requires undesired operator interaction and causes invaluable production time to be wasted. Further, in practice, broken or defective pills, even if identified as such by an inspection device such as a camera, will often nonetheless be ejected into a bottle filled with good pills, at which point the apparatus will cease filling that bottle and send it down the production line. The production line will stop, divert the bottle marked as contaminated to a different location, and continue its process. Ultimately, those bottles marked as contaminated, containing all but one proper pills, are often disposed of entirely as waste. Not only does this practice waste production time by slowing down the line, but it amounts to an unnecessary quantity of proper pills being wasted.

Accordingly, there is a great need for a packaging apparatus which operates at a high speed, and provides a mechanism for ejecting broken or defective pills such that the ejection of said pills avoids both operator intervention and a contamination of those dispensed pills that are deemed to be proper. Additionally, the apparatus should be cost effective, both in initial cost and maintenance costs. Such an apparatus would not only eliminate wasted time and resources, but it would also facilitate heightened quality control procedures by isolating the broken or defective pills and corralling them into a single location.

BRIEF SUMMARY OF THE INVENTION

The above and other needs are met by aspects of the present invention which, according to one aspect, provides an automated packaging apparatus for depositing a predetermined amount of pills into each of a series of containers. Such an apparatus comprises at least one rotary drum, wherein each rotary drum is configured as a cylinder independently rotatable in a rotational direction about a first axis extending longitudinally therethrough and comprises a radially inward portion and a radially outward portion. The radially outward portion defines a plurality of pill apertures therein, wherein each pill aperture is adapted to receive a pill from a plurality of pills disposed adjacent to the radially outward portion of the respective cylinder. The pills are received by the pill apertures at a first angular position of the at least one rotary drum. A negative pressure system is operably engaged with the radially inward portion of the at least one rotary drum and is configured to be in fluid communication with the pill apertures thereof. The negative pressure system is configured to apply a negative pressure to the pill apertures so as to retain the pills therein, as the at least one rotary drum rotates about the first axis. At least two ejection devices, a first ejection device and a second ejection device, are operably engaged with the radially inward portion of the at least one rotary drum and are configured to be in communication with the pill apertures thereof at a second angular position and a third angular position, respectively. The second angular position is angularly spaced apart from the first angular position in the rotational direction and the third angular position is angularly placed either before or after the second angular position, so as to eject the respective pills from the pill apertures outwardly of the radially outward portion. Distinct collection mechanisms are respectively disposed adjacent to the radially outward portion of the at least one rotary drum about both the second and third angular positions, wherein the collection mechanisms are configured to collect the pills ejected from the pill apertures of the at least one rotary drum about the second and third angular positions and to direct the pills toward the respective series of containers for deposition therein.

A further aspect comprises a method for depositing a predetermined amount of pills into each of a series of containers. Such a method comprises receiving a pill in each of a plurality of pill apertures defined by a radially outward portion of a rotary drum, about a first angular position thereof, wherein the rotary drum is configured as a cylinder rotatable in a rotational direction about a first axis extending longitudinally therethrough, from a plurality of pills disposed adjacent to the radially outward portion of the rotary drum. A negative pressure is applied to the plurality of pill apertures with a negative pressure system operably engaged with the radially inward portion of the rotary drum and configured to be in fluid communication with the pill apertures, so as to retain the pills within the pill apertures, as the rotary drum rotates about the first axis. The pills are ejected from the pill apertures at a second angular position of the rotary drum, wherein the second and third angular positions are angularly spaced apart from the first angular position in the rotational direction, outwardly of the radially outward portion, with an ejection mechanism operably engaged with the radially inward portion of the rotary drum and configured to be in communication with the pill apertures at the second and third angular positions. The pills ejected from the pill apertures of the rotary drum are collected, and directed toward the series of containers for deposition therein, with a collection mechanism disposed adjacent to the radially outward portion of the rotary drum about the second angular position. In one aspect, an inspection device is positioned upstream from the second and third angular positions. Thus, the inspection devices can be configured to determine the presence of the pills in the apertures and/or determine a characteristic of the pills, such as whether the pills are broken or otherwise defective. If a pill is determined to be broken or defective, said pill remains in the aperture through the second angular position. When the pill aperture rotates to the third angular position, the second ejection device is engaged and the broken or defective pill is ejected into a rejection container, where it is isolated from the collection of proper pills.

Thus, embodiments of the present invention include a packaging apparatus and associated method providing an accurate count of pills dispensed to each container. Such an apparatus requires a minimum of operator intervention, and can operate at a high speed. Additionally, such an apparatus is cost effective, both in initial cost and maintenance cost.

BRIEF DESCRIPTION OF THE SEVERAL VIEWS OF THE DRAWINGS

Figure 1:
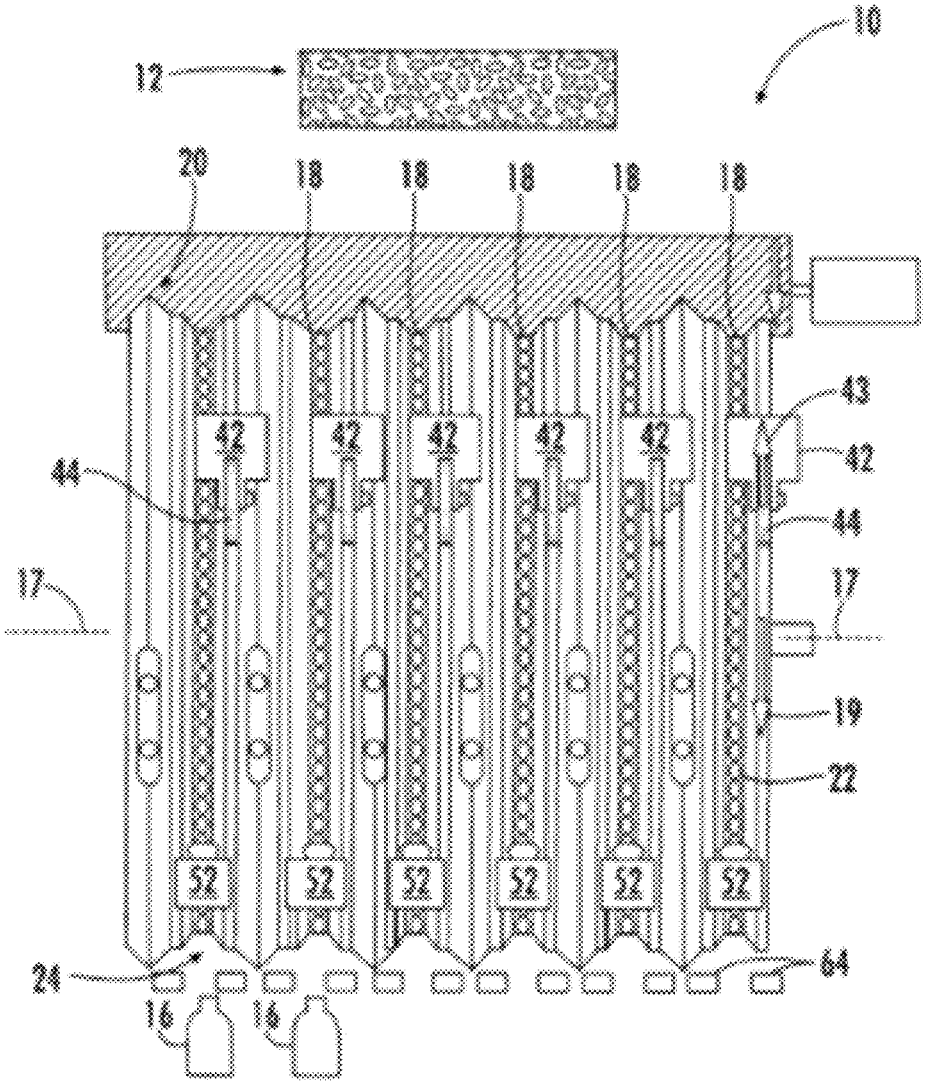
FIG. 1 PRIOR ART
Figure 2:
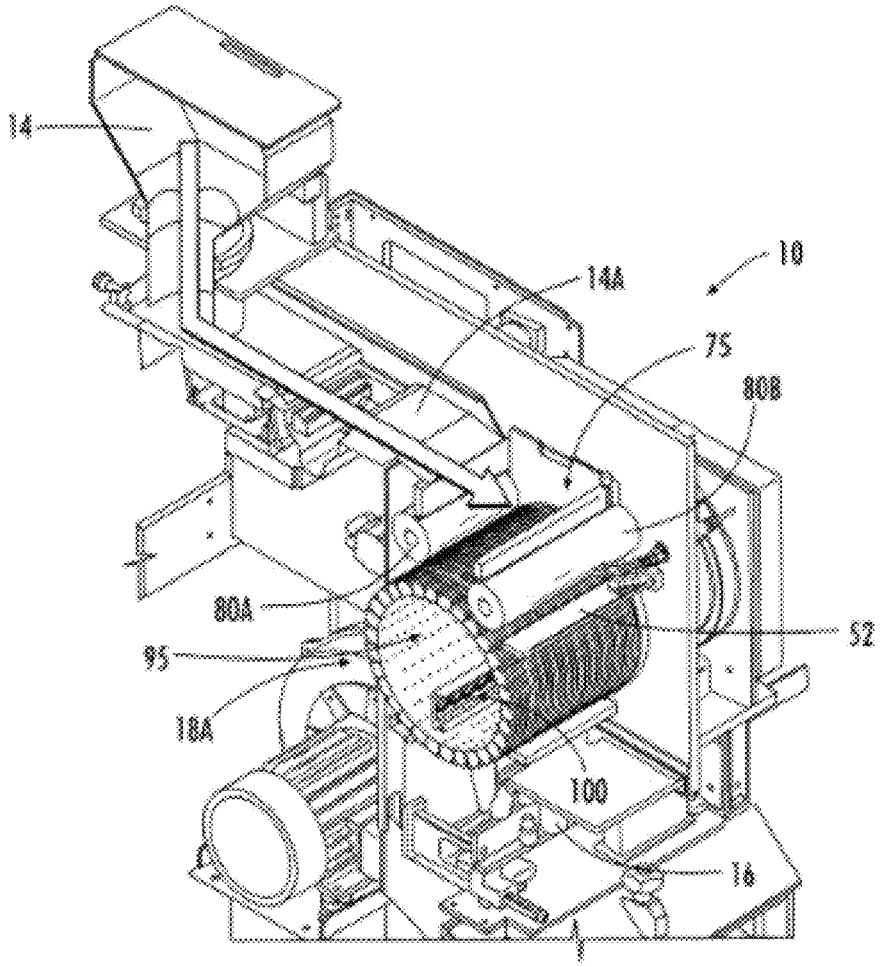
FIG. 2 PRIOR ART
Figure 3:
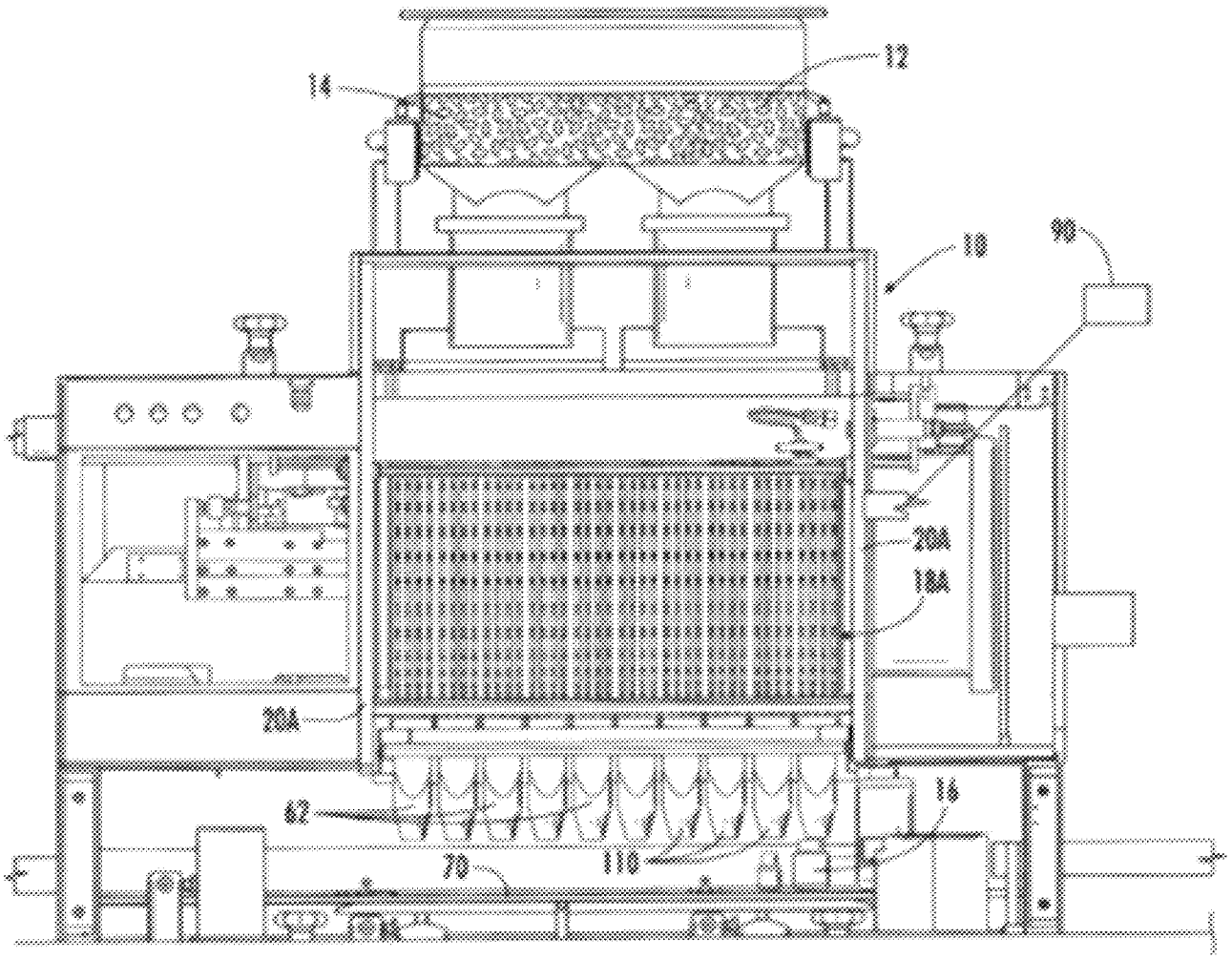
FIG. 3 PRIOR ART
Figure 4:
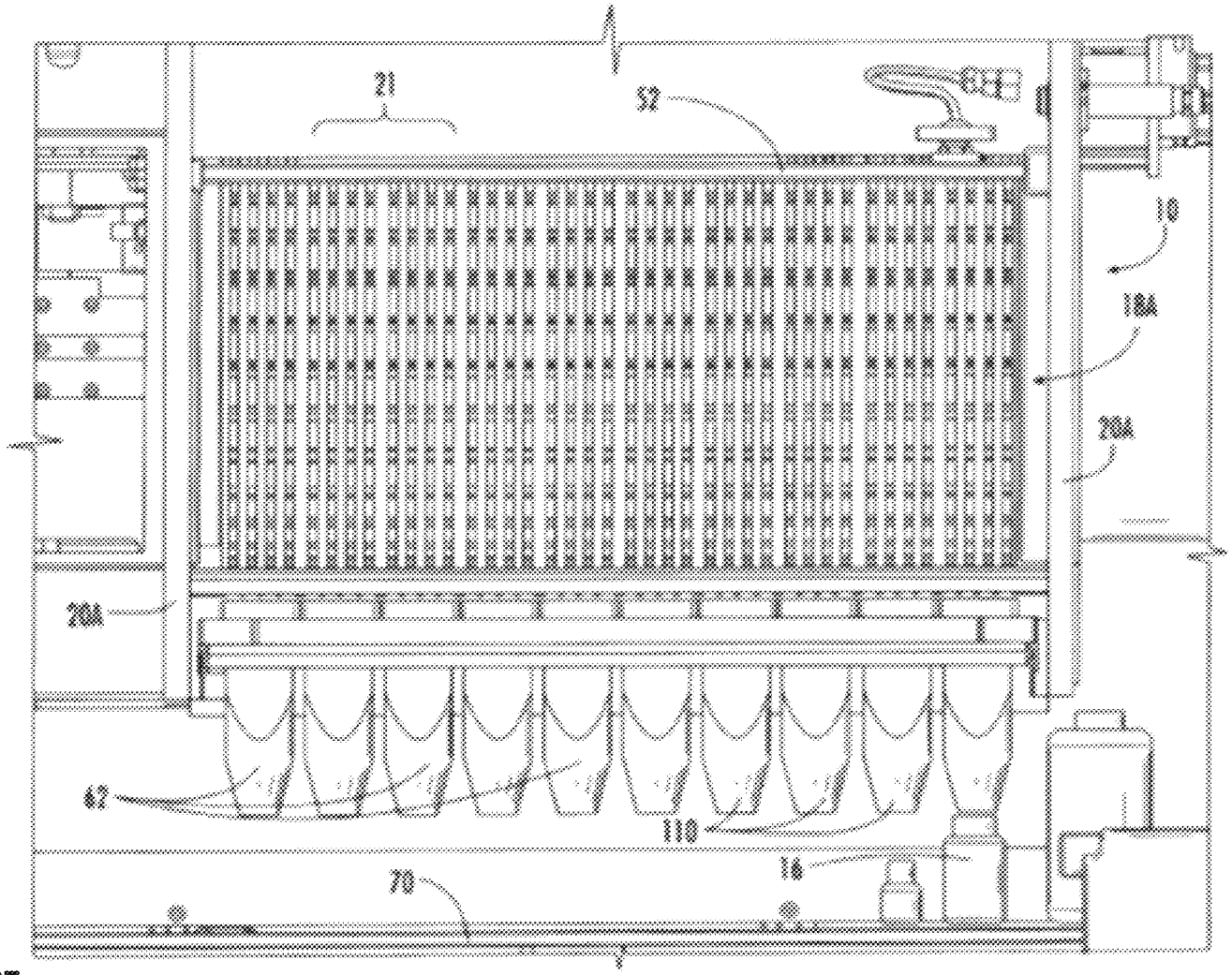
FIG. 4 PRIOR ART
Figure 5:
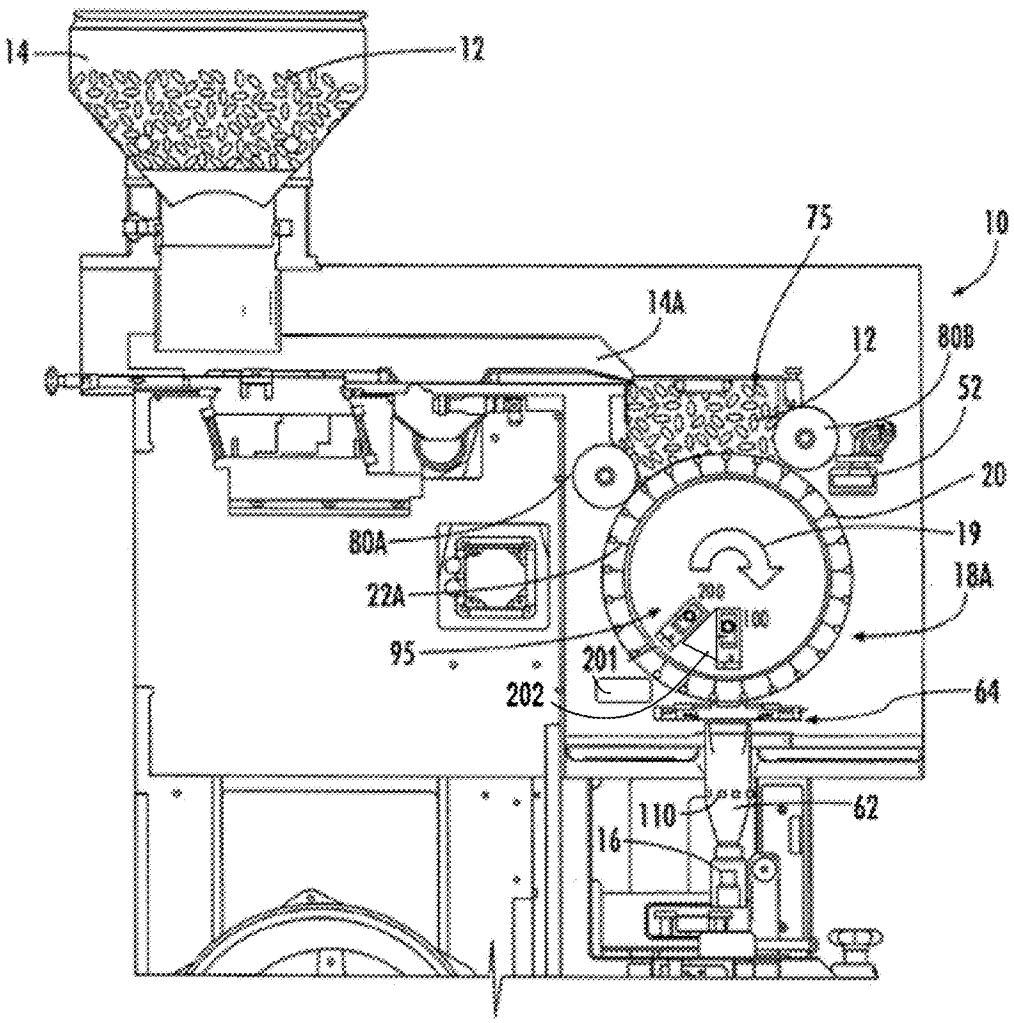
Figure 6:
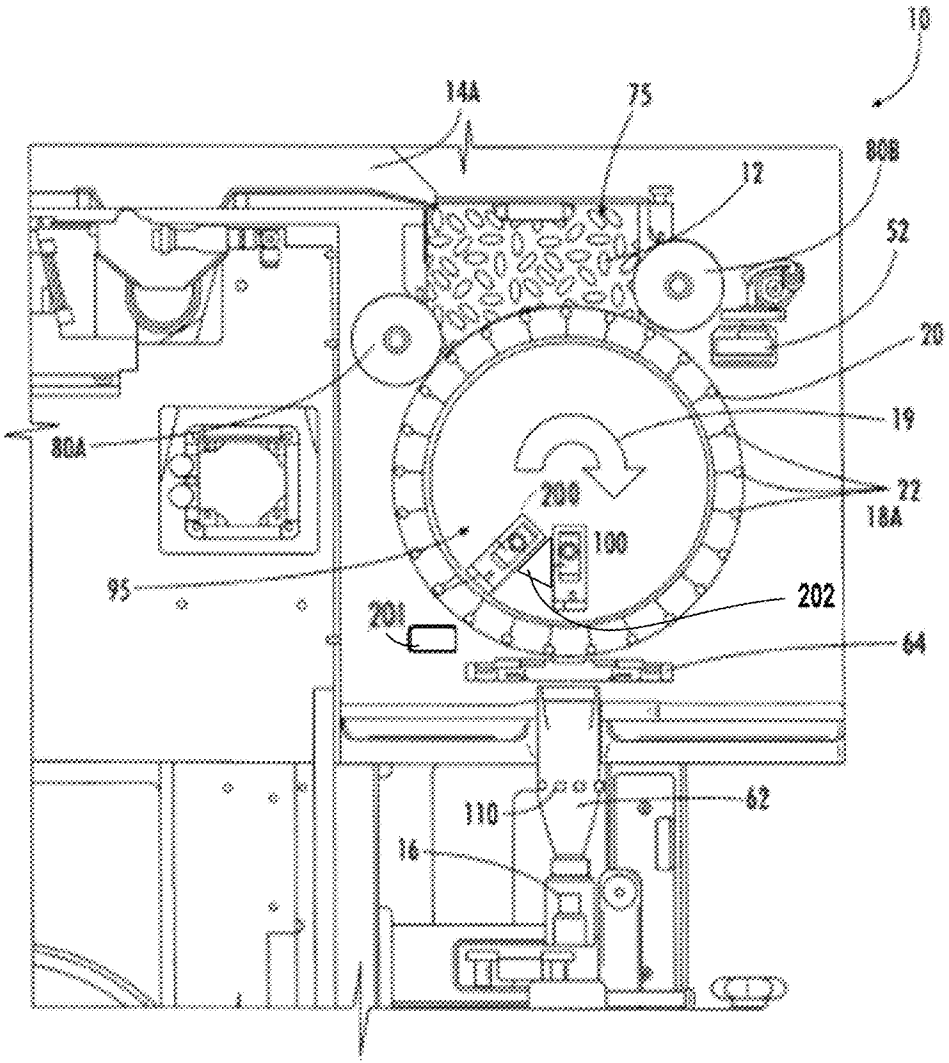
Figure 7:
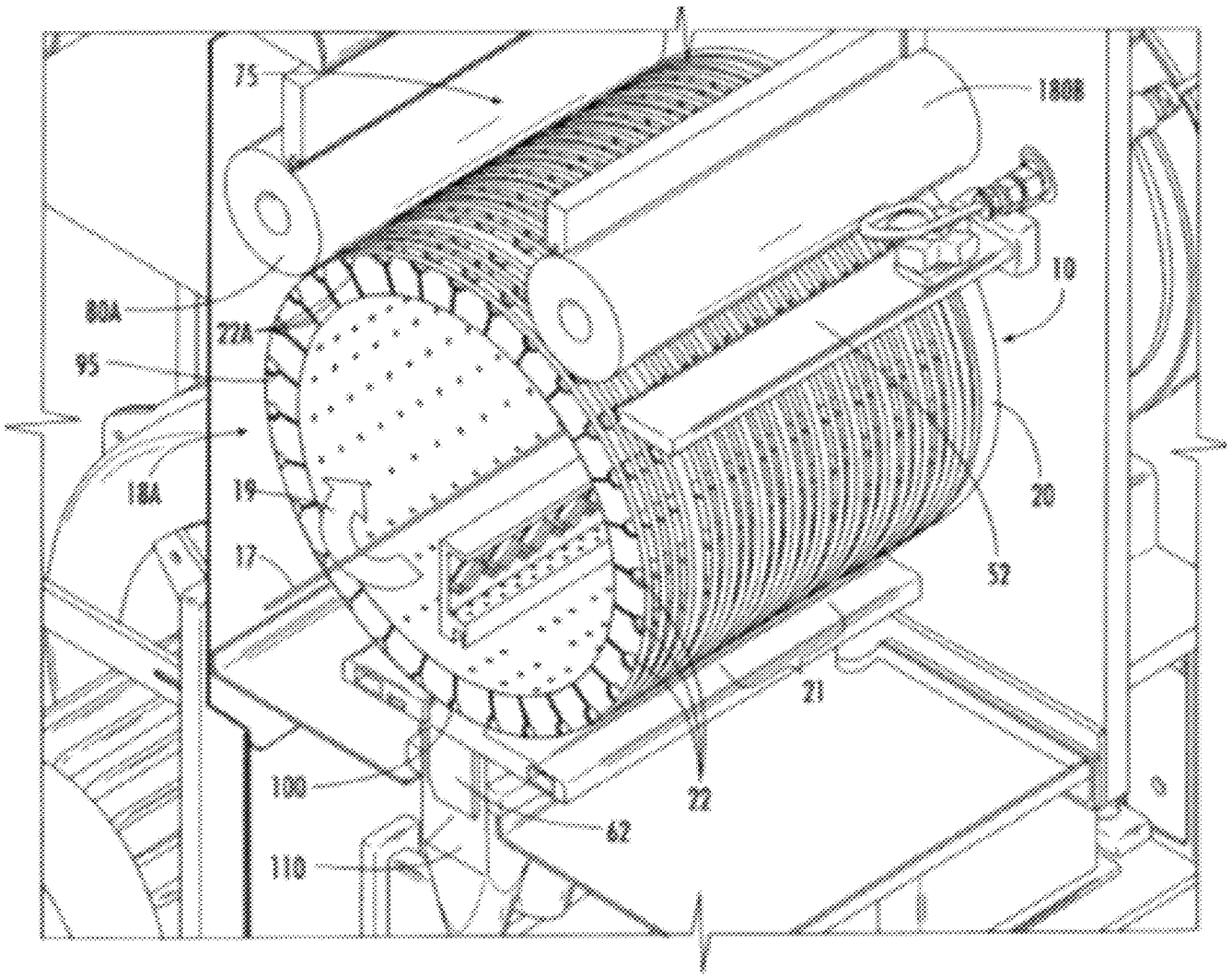
FIG. 7 PRIOR ART
Figure 8:
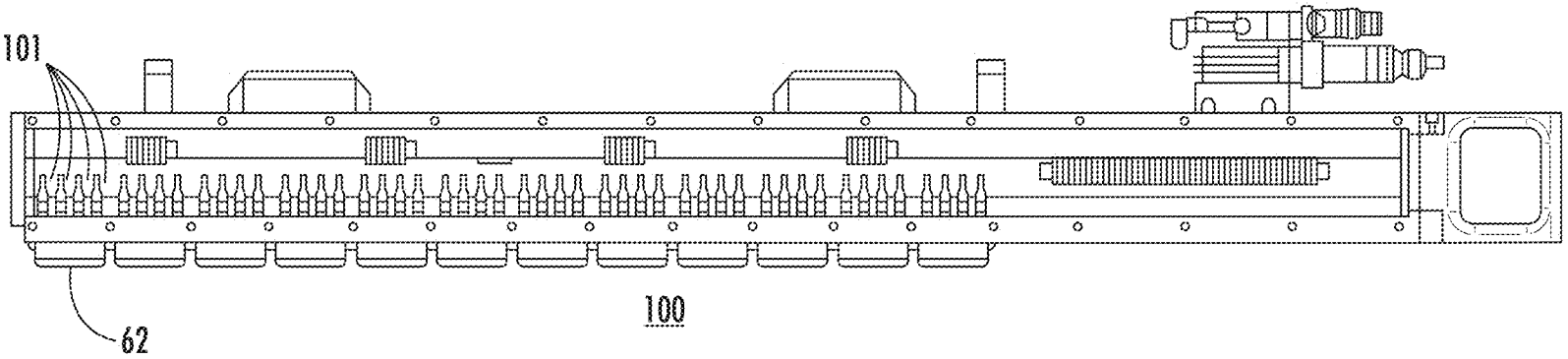
Figure 9:
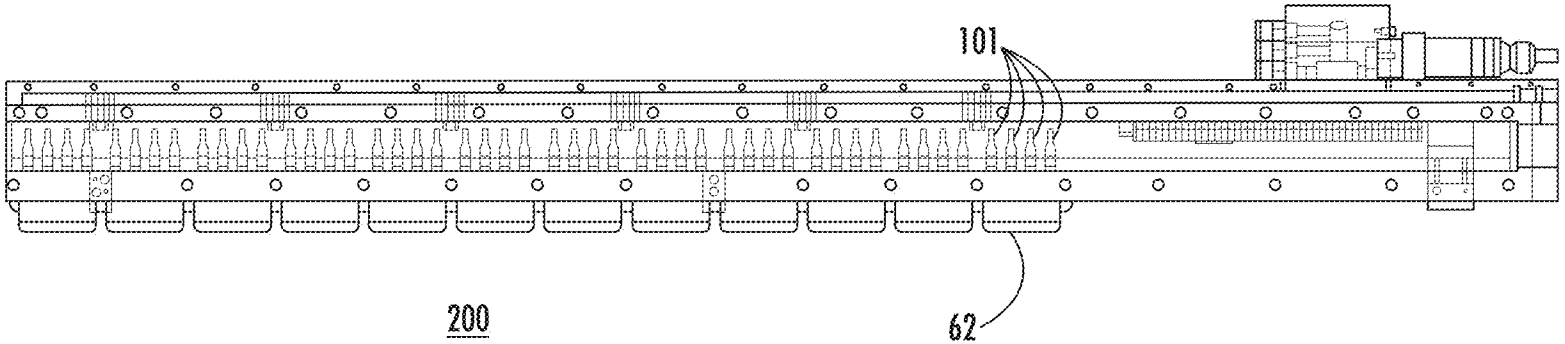
Figure 10:
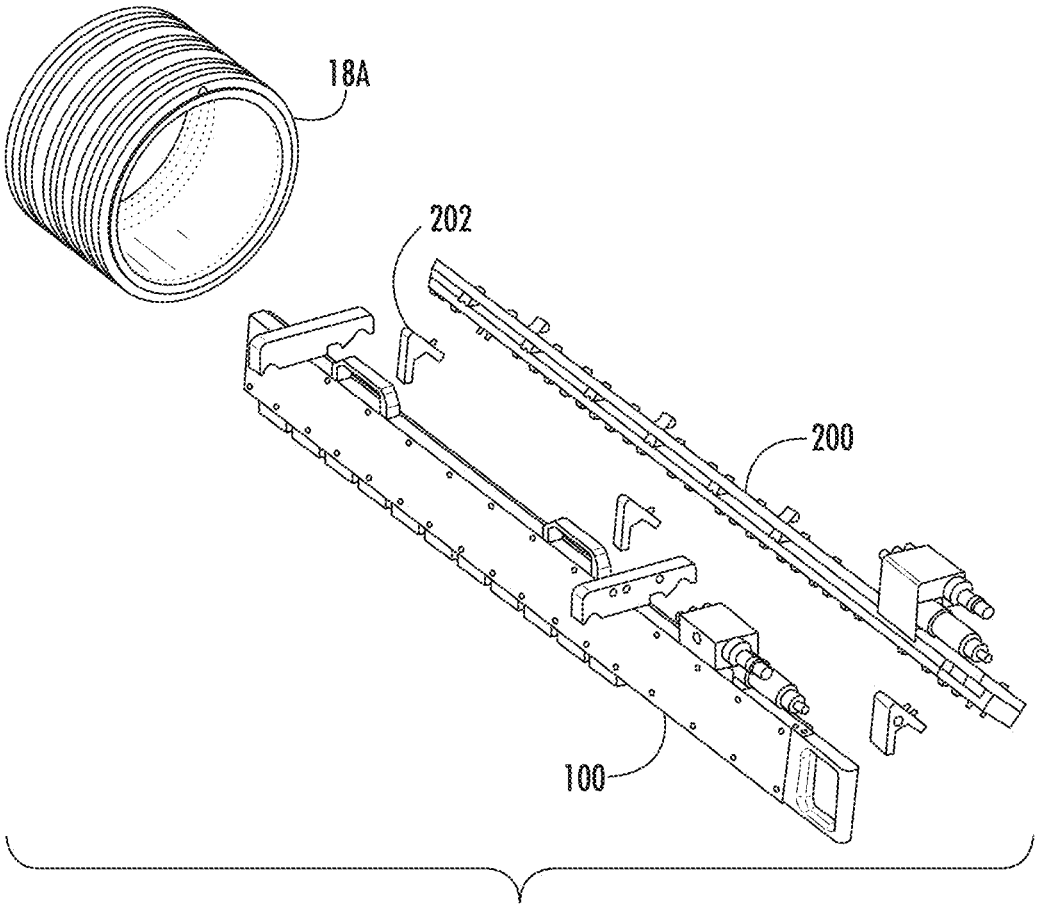
Figure 11:
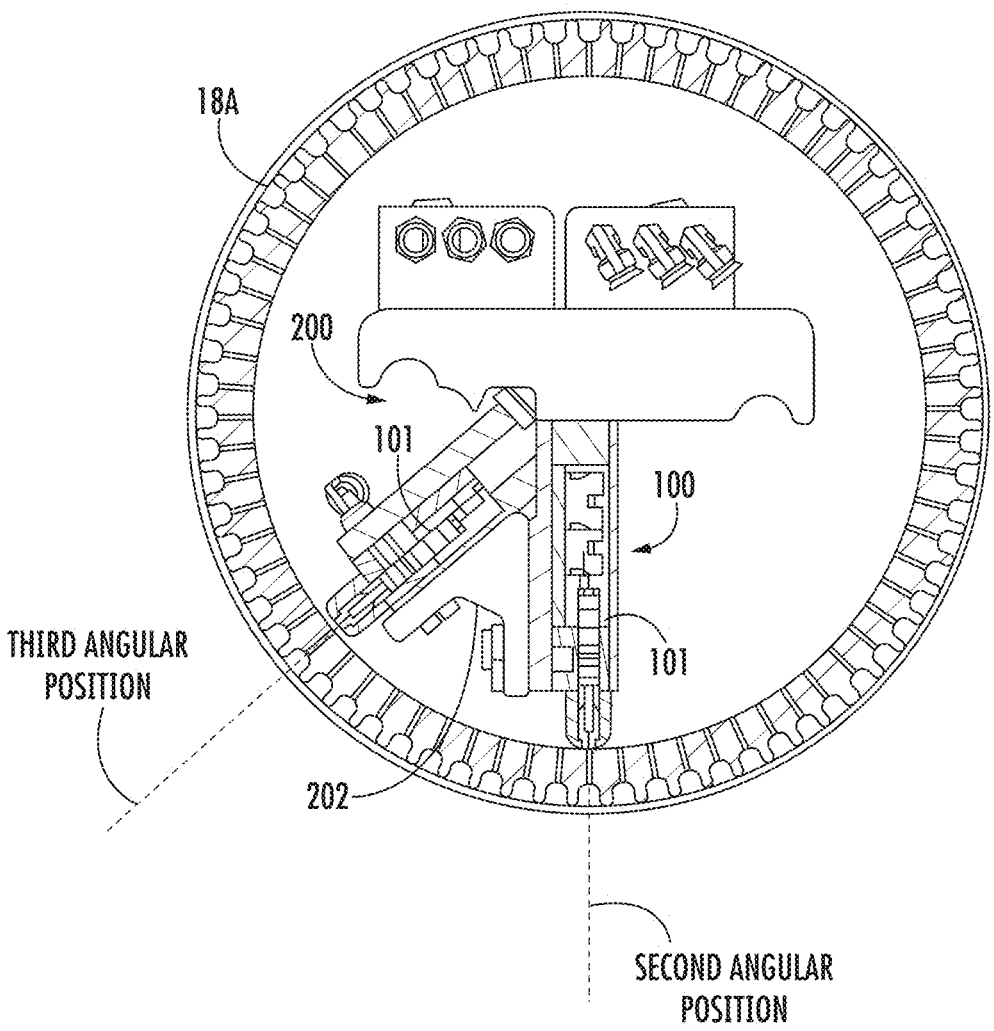

Having thus described the invention in general terms, reference will now be made to the accompanying drawings, which are not necessarily drawn to scale, wherein:

FIG. 1 schematically illustrates a pill handling apparatus according to the prior art, including a plurality of rotary slats;

FIG. 2 is a schematic cross-sectional perspective view of a pill handling apparatus according to the prior art implementing a single rotary drum and one ejection device;

FIGS. 3 and 4 are schematic elevations of the prior art pill handling apparatus of FIG. 2;

FIGS. 5 and 6 are schematic cross-sectional side views of the pill handling apparatus according to embodiments of the invention;

FIG. 7 is a schematic cross-sectional perspective view of the pill handling apparatus of FIG. 2;

FIG. 8 is a front view perspective of the first ejection device;

FIG. 9 is a front view perspective of the second ejection device;

FIG. 10 is an isometric exploded view of the first and second ejection devices configured with the rotary drum; and FIG. 11 is a cross-sectional side view of the first and second ejection devices arranged in the rotary drum.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

The present invention is generally directed to a pill handling apparatus 10, such as an automated packaging machine. Such a pill handling apparatus can be used for dispensing pills into containers, as discussed, for example, in U.S. Pat. No. 6,185,901 to Aylward, in U.S. Pat. No. 6,401,429 to Aylward, in U.S. Pat. No. 8,424,274 to Aylward, and in U.S. Pat. No. RE46,910 E to Aylward, the contents of which are incorporated herein by reference. In other embodiments, such a pill handling apparatus can be used for other handling operations, besides pill packaging, such as transporting pills during manufacture, inspection, or the like. As illustrated in FIG. 1, the pill handling apparatus 10 is adapted for delivering pills 12 from a hopper/reservoir 14 into containers 16. As used herein, the term "pill" is not intended to be limiting and includes any discrete articles of the type used in the pharmaceutical industry or otherwise including, but not limited to, capsules, caplets, gelcaps, dragees, and tablets. Similarly, the receiving containers 16, although illustrated as bottles throughout, are not limited thereto and can be any of various configurations which provide an opening for receiving discrete articles therein, such as pouches or boxes.

As shown in FIG. 1, aspects of the pill handling apparatus 10 include one or more independently rotatable rotary slats 18 for transporting pills. Each rotary slat 18 has a radially outer portion or surface 20 defining pill apertures or receptacles 22 arranged along one or more rows or paths extending about the rotary slat, and is configured to be rotatable about a longitudinal axis extending therethrough. For example, the slats 18 are illustrated to have a single circumferential path of apertures 22. In instances of multiple rows/paths, the rows/paths may be spaced apart along the rotary slat (i.e., in the axial direction along the rotary slat). Each radially outer portion 20 may, in some instances, further define a contour 24 defining a slope extending toward one or more of the apertures to facilitate the entry of pills into those apertures. In particular, the radially outer portion 20 of each rotary slat 18 may also define a contiguous groove or slot that extends circumferentially around the slat 18, with the apertures 22 being defined within the groove. In such instances, the groove may define a further contour, or comprise the contour 24, for receiving the pills 12 and guiding the pills 12 into the apertures 22. While the apertures 22 are illustrated to be pocket-like apertures that extend inwardly from the radially outer portion 20 of the slat 18, the apertures can have other configurations. For example, the apertures can be holes, grooves, or flat portions defined by the exterior portion of the slat 18, or the like. Thus, the apertures 22 can define positions on the outer surface of the slat 18 where the pills 12 are received, i.e., positioned, and held during transport of the pills to the containers 16. The apertures need not define a contour that corresponds to the shape of the pills, and the apertures can be provided with or without the groove(s). That is, the apertures can be defined on or by the outer surface of the slat, or on or by the surface of an inwardly-extending groove.

In one particular aspect, as shown in FIGS. 2-7, the pill handling apparatus 10 may include a single rotary slat configured, for instance, as a single rotary drum 18A defining the apertures 22. In such instances, the apertures 22 may be arranged in a plurality of rows 21 extending along the rotary drum 18A, with each row 21 extending circumferentially about the rotary drum 18A (i.e., a configuration which may be likened to securing a plurality of axially-adjacent rotary slats 18 together to form the rotary drum 18A—in this manner, for example, the cost and complexity of the pill handling apparatus 10 may be reduced by eliminating, for instance, servos and controls associated with a plurality of independently-rotatable rotary slats). The disclosure herein will thus be exemplarily presented with respect to such a single rotary drum 18A, though one skilled in the art will appreciate that the principles disclosed herein may be similarly applicable to a pill handling apparatus 10 comprised of a plurality of independently-rotatable rotary slats.

As shown in FIGS. 2, 3, 5, and 6, the pills 12 are fed from the reservoir 14 to and along a chute member 14A, toward the radially outward portion 20 of the rotary drum 18A. The pills 12 are directed to a containment area 75 about the radially outward portion 20 of the rotary drum 18A, wherein the containment area 75 may be defined or otherwise formed, for example, by opposing containment members 80A, 80B angularly spaced-apart about the radially outward portion 20. The containment members 80A, 80B may comprise, for example, rollers in contact with the radially outward portion 20 and rotatable about longitudinal axes defined thereby, with the rollers being of sufficient diameter to effectively provide opposing walls for receiving and holding the pills 12 therebetween. If necessary, the opposed lateral sides of the rotary drum 18A may have retaining plates 20A operably engaged therewith for cooperating with the containment members 80A, 80B to retain the pills 12 within the containment area 75 associated with the rotary drum 18A. The containment area 75 is thus configured to introduce the pills 12 to the radially outward portion 20 of the rotary drum 18A defining the plurality of apertures 22. The relative rotary motion of the rotary drum 18A, as well as the containment members 80A, 80B may, in some instances, agitate the pills 12 in the containment area 75 so as to facilitate insertion of the pills 12 into the apertures 22 defined by the rotary drum 18A. In other instances, the downstream containment member 80B may serve as a "brush" for facilitating insertion of the pills 12 into the apertures 22 by brushing or rolling over the radially outward surface 20 after the pills 12 are directed into the apertures 22 in the containment area 75. The pills 12 are therefore introduced into and received by the apertures 22 within the containment area 75 about a first angular position of the rotary drum 18A, as the rotary drum 18A rotates about the longitudinal axis 17 thereof in a rotational direction 19.

In some instances, a controller or controller device (not shown) may also be in communication with a level sensor (not shown) within the containment area 75, and a reservoir gate switch (not shown) controlling a reservoir gate (not shown) disposed between the reservoir 14 and the containment area 75 (i.e., along the chute 14*a*). The level sensor may be configured to detect the quantity of pills 12 in the containment area 75 and to communicate a corresponding value or signal to the controller so as to appropriately control the feed of the pills from the reservoir 14 via the reservoir gate/reservoir gate switch. For example, the level sensor can detect the level of pills 12 in the containment area 75 associated with the rotary drum 18A and, when the controller detects that the level of pills 12 is below the desired level, the controller signals the reservoir gate switch to open the reservoir gate to release more pills from the reservoir 14 toward the containment area 75. By opening and closing the reservoir gate, the controller maintains a desired number of pills 12 within the containment area 75. The desired level of pills 12 may thus be adjusted, for example, to optimize the seating of pills 12 in the pill apertures 22 and/or to prevent loss, wear or breaking of the pills 12 caused by overfilling of the containment area 75.

As shown in FIG. 1, in configurations involving multiple slats 18, each slat 18 may be independently rotated by a respective drive motor 42 and drive wheel 44 to transport pills independently of the other slats 18. Each rotary slat 18 rotates in a first direction 19 defining an arcuate delivery path in the rotational direction 19, between the containment area 75 about the first angular position and a second angular position, angularly spaced apart from the first angular position, where the pills 12 are released. In some instances, for example, the first angular position may be about a "twelve o'clock" position, and the second angular position may be about a "six o'clock" position, with the slat 18 rotating in a clockwise direction. In such a drive arrangement for the slats 18, the drive wheels 44 may be turned by the motors 42 in a second direction 43, rotationally opposite the first direction 19. The drive wheels engage the outer surfaces 20 by friction or geared engagement and turn the rotary slats in the first direction 19. In a similar manner, the single rotary drum 18A, as shown in FIGS. 2-7, may be engaged with and rotated by a drive arrangement or mechanism (not shown) to transport the pills 12 in the apertures 22 from the containment area 75 in the first direction 19, an arcuate delivery path, to the second angular position, where the pill 12 is released. In one instance, the second angular position is about 180 degrees away from the first angular position about the containment area 75, with the first angular position being, for instance, about the "twelve o'clock" position, and the second angular position being, for instance, about the "six o'clock" position. The drive arrangement may be configured, for example, to engage the radially outward portion 20 of the rotary drum 18A by friction or geared engagement to turn the rotary drum 18A in the first direction 19.

As shown in FIGS. 5 and 6, in configurations involving multiple slats of rotary drum 18A, each slat of rotary drum 18A may be independently rotated by a respective drive motor 42 and drive wheel 44 to transport pills independently of the other slats of rotary drum 18A. Each rotary slat of rotary drum 18A rotates in a first direction 19 defining an arcuate delivery path in the rotational direction 19, between the containment area 75 about the first angular position, a second angular position, angularly spaced apart from the first angular position, and a third angular position angularly spaced apart from both the first and second angular positions. The pills 12 may be released at either the second angular position or the third angular positions. In some instances, for example, the first angular position may be about a "twelve o'clock" position, and the second angular position may be about a "six o'clock" position, with the slat of rotary drum 18A rotating in a clockwise direction. The third angular position may be situated either before or after the second angular position. In a similar manner, the single rotary drum 18A, as shown in FIGS. 5-6, may be engaged with and rotated by a drive arrangement or mechanism (not shown) to transport the pills 12 in the apertures 22 from the containment area 75 in the first direction 19, an arcuate delivery path, to the second angular position, and further to the third angular position. The pill 12 may be released at either the second angular position or the third angular position. In one instance, the second angular position is about 180 degrees away from the first angular position about the containment area 75, with the first angular position being, for instance, about the "twelve o'clock" position, and the second angular position being, for instance, about the "six o'clock" position. The third angular position may be situated either before or after the second angular position. The drive arrangement may be configured, for example, to engage the radially outward portion 20 of the rotary drum 18A by friction or geared engagement to turn the rotary drum 18A in the first direction 19.

In some embodiments, a negative pressure or vacuum assembly 90 (see, e.g., FIG. 3) may be operably engaged with and in fluid communication with the interior portion 95 of the rotary drum 18A to apply suction thereto. In this regard, the apertures 22 defined by the rotary drum 18A may be in fluid communication with the interior portion 95 of the rotary drum 18A through, for example, one or more channels 22A extending therebetween. As such, since the suction may be applied generally to the interior portion 95 of the rotary drum 18A, air may be simultaneously drawn into all (or at least a portion) of the apertures 22 defined by the rotary drum 18A through the respective channels 22A. The suction imparted to the apertures 22 by the negative pressure assembly 90 via the interior portion 95 of the rotary drum 18A and via the channels 22A may thus, for instance, facilitate the reception of the pills 12 in the apertures 22 about the first angular position (containment area 75), and act upon the pills 12 received by the apertures 22 to retain pills 12 therein as the rotary drum 18A rotates at least from the first angular position (containment area 75) to either the second angular position or the third angular position in the rotational direction 19. One skilled in the art will appreciate that the negative pressure assembly 90 may be configured in many different manners to provide the negative pressure acting upon the apertures 22. For example, the suction may be created using a fan, pump, or other appropriate low pressure source cooperating with the interior portion 95 of the rotary drum 18A, through a vacuum port engaged therebetween. As such, in some instances, all apertures 22 may be simultaneously exposed to or otherwise in simultaneous fluid communication with the suction applied to the interior portion 95 of the rotary drum 18A via the negative pressure assembly 90 such that air is drawn into the apertures 22 and through the air passages or channels 22A into the interior portion 95, via the vacuum port, when acted upon by the negative pressure assembly 90.

Thus, pills 12 deposited into the containment area 75 are urged toward receipt and capture by the apertures 22 because of the air currents and pressure differentials present at the apertures 22 due to the suction imparted by the vacuum assembly 90 via the interior portion 95. In some cases, the pills, once seated in the receptacles, partially or entirely block the air passages 22A. Thus, these descriptions relate to configurations wherein each seated pill completely seals the receiving receptacle to prevent further air flow, configurations wherein each seated pill partially seals the receiving receptacle to limit further air flow, and configurations wherein air flow is permitted without significant reduction by a pill seated in a receptacle.

As the rotary drum 18A rotates in the rotational direction, one or more of the pill-containing apertures 22 arrives at the first possible release or second angular position. However, the pills 12 remain retained in the apertures 22 due to the suction imparted thereto by the negative pressure system 90. As such, aspects of the present invention further comprise a first ejection device/mechanism 100 configured to eject the pills 12 from the apertures 22 disposed at the second angular position. In one instance, the first ejection mechanism 100 may comprise, for example, an air emission device operably engaged with the interior portion 95 of the rotary drum 18A at the second angular position (i.e., at the "six o'clock" position). The first air emission device 100 may be configured to be capable of communicating with the apertures 22 at the second angular position via the respective channels 22A, wherein the air emitted thereby may be positively pressurized so as to at least negate the suction provided by the negative pressure system 90. In this manner, upon actuation of the first air emission device 100, the suction is at least negated with respect to the selected aperture 22, wherein the pill 12 may thus be non-contactingly ejected therefrom. However, in some instances, it may be desirable to effect a more positive ejection of the pill 12 from the aperture 22, for example, such that the ejected pill is not pulled back into the aperture 22 by the suction, or such that a positive pill dispensation can be achieved, so as to increase the overall pill packaging rate. As such, the first air emission device 100 may be configured, in some instances, to provide the air at a positive pressure sufficient to overcome the effect of the suction imparted to the apertures 22 (i.e., the positive pressure of the air supplied by the first air emission device 100 is greater in magnitude than the suction imparted to the apertures 22) whereby the pill 12 is positively ejected from the respective aperture 22 at the second angular position. Such a configuration may also provide a positive pill count pill packaging apparatus 10 and/or an inspection device(s) 52 wherein a pill 12 is not released from the aperture 22 of the rotary drum 18A, unless that pill count is needed and/or the pill is determined by the inspection device(s) 52 to be neither broken nor defective.

As the rotary drum 18A continues to rotate in the rotational direction, one or more of the pill-containing apertures 22 arrives at the second possible release or third angular position. However, as previously described, the pills 12 remain retained in the apertures 22 due to the suction imparted thereto by the negative pressure system 90. As such, aspects of the present invention further comprise a second ejection device/mechanism 200 configured to eject the pills 12 from the apertures 22 disposed at the third angular position. In one instance, the second ejection mechanism 200 may comprise, for example, an air emission device operably engaged with the interior portion 95 of the rotary drum 18A at the third angular position. In one instance, the second air emission device 200, located at the third angular position, and the first air emission device 100, located at the second angular position, are rigidly and angularly separated in the rotational direction by an angular support bracket 202. In this instance, the angle of the angular support bracket 202 is such that the second air emission device 200 is positioned in the third angular position when connectedly secured to the angular bracket support 202. Like the configuration of the first air emission device 100, the second air emission device 200 may be configured to be capable of communicating with the apertures 22 at the third angular position via the respective channels 22A, wherein the air emitted thereby may be positively pressurized so as to at least negate the suction provided by the negative pressure system 90. In this manner, upon actuation of the second air emission device 200, the suction is at least negated with respect to the selected aperture 22, wherein the pill 12 may thus be non-contactingly ejected therefrom. However, in some instances, it may be desirable to effect a more positive ejection of the pill 12 from the aperture 22, for example, such that the ejected pill is not pulled back into the aperture 22 by the suction, or such that a positive pill dispensation can be achieved, so as to increase the overall pill packaging rate. As such, the second air emission device 200 may be configured, in some instances, to provide the air at a positive pressure sufficient to overcome the effect of the suction imparted to the apertures 22 (i.e., the positive pressure of the air supplied by the second air emission device 200 is greater in magnitude than the suction imparted to the apertures 22) whereby the pill 12 is positively ejected from the respective aperture 22 at the third angular position.

The first and second air emission devices 100, 200 may be configured, for example, as a parallel collection of supply tubes (not shown) corresponding to the number of rows 21 of apertures 22 defined by the rotary drum 18A, wherein each supply tube would extend into the interior portion 95 of the rotary drum 18A to a position in which the respective supply tube is capable of communicating with a channel 22A leading to a pill-containing aperture 22 at the second and third angular positions, respectfully. A collection of valves 101, corresponding to the number of supply tubes, may be disposed outside of the rotary drum 18A and in communication with the respective supply tube, wherein selective control of the collection of valves 101 may accomplish the selective pill dispensation from the apertures 22, as disclosed herein. In other instances, the first and second air emission devices 100, 200 may each comprise, for instance, a single manifold device extending into the interior portion 95 of the rotary drum 18A. In such instances, the collection of valves 101 may be engaged with the manifold device within the interior portion 95, with the manifold device otherwise being capable of communicating with the channels 22A leading to a pill-containing apertures 22 at the second and third angular positions, respectively, via the collection of valves 101. Selective control of the collection of valves 101 engaged with the manifold may thus also accomplish the selective pill dispensation from the apertures 22, as disclosed herein. In either instance, the collection of supply tubes or the manifold device may be configured to be in communication with a positive pressure source (not shown) for receiving positively pressurized air therefrom.

Further, since the first and second ejection devices 100, 200 may be configured to provide a positive count and selective ejection of the pills 12 from the apertures 22, particular schemes for filling the respective containers 16 may be implemented. In one instance, the pill handling apparatus 10 may be further configured to include a plurality of collection mechanisms 62 disposed about the radially outward portion 20 of the rotary drum 18A about the second and third angular positions. Such a plurality of collection mechanisms may comprise, for example, a chute member 62 extending between the rotary drum 18A at the second angular position, and a container 16 to be filled with pills 12. Such a plurality of collection mechanisms may further comprise a chute member 62 extending between the rotary drum 18A at the third angular position, and a rejection container 201 as shown in FIGS. 5 and 6 into which broken or defective pills may be ejected by the second ejection device 200. According to one aspect, a single container 16 may be provided with pills 12 through one or more chute members 62 collecting pills 12 from one or more rows 21 of apertures 22. That is, a chute member 62 may extend across and collect pills 12 from more than one row 21 of apertures 22. In some instances, such "grouped" rows 21 of apertures 22 may communicate with a single container 16 through a single chute member 62 and thereby possibly increase machine throughput (i.e., by increasing the fill rate). For example, each container 16 aligned adjacent to the radially outward portion 20 of the rotary drum 18A at the second angular position can be provided with pills 12 (whether simultaneously between the containers 16 or not) by a single chute member 62 extending across a plurality of rows 21 of apertures 22 (i.e., four rows). In such an instance, the first ejection device 100 may be configured so as to be selectively actuatable for each of the four rows (i.e., individual valves 101 extending from a manifold or affecting individual supply lines).

However, in other instances, the first ejection device 100 may be configured so as to be selectively actuatable for three of the four rows, simultaneously, and be separately selectively actuatable for the fourth row of apertures 22. For example, three of the four rows of apertures 22 may share a single actuatable valve 101, whereby actuation of the valve 101 ejects three pills 12 simultaneously from an aperture 22 in each of those three rows. The fourth and last row may have a separately actuatable valve 101 associated therewith for selectively ejecting pills 12 from the apertures 22 in that fourth row. In this manner, a "coarse fill" function could be provided by simultaneously actuating both valves 101 for ejecting pills 12 from all four rows into the chute member 62 and toward the container 16. Once the pill count approaches the desired number of pills 12 dispensed into the container 16, or if an undercount situation is detected, the actuation of the valve 101 associated with the three rows can be discontinued, and the valve 101 associated with the single row can continue to be selectively actuated so as to provided one pill at a time (i.e., a "fine fill" function), until the desired full count of pills 12 in the container 16 is attained (i.e., prevent "overfilling" of the container 16).

As illustrated in FIGS. 1-7, the pill handling apparatus 10 may further include one or more inspection devices 52 disposed adjacent to the radially outward portion 20 of the rotary drum 18A for inspecting, detecting, counting, or otherwise analyzing the pills 12 carried in the apertures 22. In some instances, each inspection device 52 can be an optical imaging device, such as a camera, that inspects the pills 12 by detecting an image of each pill to determine the size, shape, or other characteristics of the pill. Thus, the inspection devices 52 can be configured to determine the presence of the pills 12 in the apertures 22 and/or determine a characteristic of the pills 12, such as whether the pills 12 are broken or otherwise defective. If a pill is determined to be broken or defective, such a determination can be communicated to both the first ejection device 100 and the second ejection device 200 by way of a controller such that the particular broken/defective pill is not dispensed into a container 16 at the second angular position. The broken/defective pill remains suctioned to the aperture 22 until it reaches the second ejection device 200, located at the third angular position, where it is dispensed into a rejection container 201. The reject container 201 can be in the form of a tray or a bottle or the like to allow subsequent inspection of the rejected pills, or the rejected pills may be routed directly to a waste receptacle. Such a configuration facilitates heightened quality control procedures by isolating the broken or defective pills and corralling them into a single location, thereby simplifying the post-failure inspection process and other quality control procedures required by the strict regulations pharmaceutical industry by eliminating the need to search extensively for a lone rogue bad pill. Further, the isolation and collection of all broken or defective pills in a singular location assists in maintaining thorough and accurate inventory procedures, thus alleviating present concerns of operator or other human intervention, theft, and subsequent abuse of such pills. In some instances, the third angular position may be arranged before the second angular position in the rotational direction. In such a configuration, the second ejection device 200 is correspondingly located before the first ejection device 100 and ejects the broken/defective pill into the rejection container 201 before the pill has the opportunity to reach the first ejection device 100. The inspection device(s) 52 can be disposed downstream of the reservoir 14 (i.e., following the downstream containment member 80B) for inspecting pills 12 in the apertures 22.

As further shown in FIGS. 1, 5, and 6, the number of pills 12 delivered to each container 16 can be determined and used to direct the operation of the ejection device 100. In this regard, one or more pill-counting devices 64 can be associated with each collection mechanism 62. Each pill-counting device 64 can be disposed between the rotary drum 18A and the respective container 16. For example, each pill-counting device 64 can be positioned adjacent, above, below, or within a respective chute member 62 so that any pill 12 which travels through the chute member 62 will be detected by the counting device 64. While the pill-counting devices 64 and inspection device(s) 52 are illustrated as different components, a combined detection device can alternatively be provided, in some instances, for performing the counting and/or inspecting of the pills 12. One exemplary pill-counting device 64 may include, for instance, a light source, and a light receiver positioned substantially opposite the light source, wherein the light source generates a light beam that is detected by the opposing light receiver. When the light beam is interrupted by a falling pill 12, the light receiver produces a signal which increases the ongoing pill count for a particular container 16. Thus, the number of interruptions of the pill-counting device 64 corresponds to the number of pills 12 which have been delivered into the container 16.

In order to position empty containers 16 for receiving the pills 12 from the rotary drum 18A, and moving the filled containers 16 away therefrom for further processing or packaging, the pill handling apparatus 10 may further include a conveyor system or conveying device 70 operably engaged therewith for handling the containers 16. For example, the containers 16 can be supported by a conveyor belt 70 (FIGS. 1-7) that is driven by a motor (not shown), in a direction parallel to the axis 17 about which the rotary drum 18A rotates. Stop gates (not shown) may be disposed proximate to the conveyor belt 70 and configured to be extended to block the path of the containers 16 on the conveyor belt 70, and to hold the containers 16 in positions corresponding to the collection mechanisms 62. A further stop gate can be extended to block the path of further unfilled containers 16, before such containers 16 are moved adjacent to the rotary drum 18A, until the preceding containers 16 are filled. Alternatively, a screw auger (not shown) can be used to transport the containers 16 and position the containers adjacent to the rotary drum 18A. The screw auger can maintain the containers 16 at consecutively spaced intervals, and as the screw auger is rotated, each of the containers 16 is transported toward or away from the rotary drum 18A. Rotation of the screw auger can be adjusted to control the speed and direction of the movement of the containers 16.

Many modifications and other embodiments of the invention will come to mind to one skilled in the art to which this invention pertains having the benefit of the teachings presented in the foregoing descriptions and the associated drawings. For example, one skilled in the art will appreciate that, while the illustrated vacuum assembly 90 is used to maintain the pills 12 in the apertures 22 between the first and second angular positions, a shroud or cover can be additionally provided about the radially outward portion 20 of the rotary drum 18A, extending at least between the first and second angular positions for preventing the release of the pills 12 from the apertures 22 therebetween.

In addition, for instance, the collection mechanism 62 may further comprise a selectively actuatable stop gate 110, in some embodiments, disposed within the chute member 62, following the chute member 62, or otherwise operably engaged with the chute member 62, after the pills 12 directed through the chute member 62 are counted by the pill-counting device(s) 64 and/or inspection device(s) 52 and before the pills 12 are deposited within the container 16. In this manner, when the desired pill count is reached for the container(s) 16 corresponding to the chute member 62, the stop gate 110 may be actuated to interrupt the delivery path to the container 16 and accumulate pills 12 dispensed from the rotary drum 18A and counted by the pill-counting device 64/inspection device 52, while the conveyor system/conveying device 70 moves another container 16 into registration with the chute member 62 for accepting pills 12. Once the next container 16 is in registration with the chute member 62, the stop gate 110 can then be de-actuated, to re-open the pill delivery path through the chute member 62 and to release the counted and accumulated pills 12 into the container 16. As such, the actuatable stop gate 110 associated with the chute member 62 for overlapping the pill counting and container indexing functions, may serve to increase the throughput of the pill handling apparatus 10 since the dispensing function of the rotary drum 18A/ejection device 100 may not have to be halted while the conveying device 70 moves a new container 16 or series of containers 16 into registration with the collection mechanism(s) 62. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

CONCLUSION

Many modifications and other embodiments will come to mind to one skilled in the art to which this disclosure pertains having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An automated packaging apparatus for selectively depositing a predetermined amount of pills into one or more containers based on one or more pill characteristics, comprising:

a rotary drum configured as a cylinder rotatable in a rotational direction about a first axis extending longitudinally therethrough, the rotary drum comprising a radially inward portion and a radially outward portion, the radially outward portion defining a plurality of pill apertures, each of the pill apertures being configured to receive therein a pill from a plurality of pills disposed adjacent to the radially outward portion of the rotary drum;

a negative pressure system operably engaged with the radially inward portion of the rotary drum and in fluid communication with one or more of the plurality of pill apertures, the negative pressure system configured to apply a negative pressure to the one or more pill apertures so as to retain the pills therein as the rotary drum rotates about the first axis;

at least a first ejection device and a second ejection device positioned rotationally downstream from the first ejection device, each ejection device being operably engaged with the radially inward portion of the rotary drum and configured to be in communication with the pill apertures thereof at a respective angular position, wherein the apparatus is configured to selectively eject one or more of the pills from the corresponding pill apertures outwardly of the radially outward portion at the respective angular position of the at least first ejection device and second ejection device;

at least a first ejection receptacle and a second ejection receptacle configured to collect the pills ejected by respective ones of the at least first and second ejection devices from the plurality of pill apertures of the rotary drum;

at least one inspection device operably engaged with the rotary drum and at least one of the first and second ejection devices, each inspection device being configured to analyze each of the pills retained within the plurality of pill apertures, wherein analyzing a pill comprises determining one or both of the presence of a pill and at least one pill characteristic associated with the pill; and wherein the apparatus is configured to control the at least first ejection device and second ejection device to selectively eject one or more of the pills from a corresponding pill aperture of the rotary drum to one of the at least first ejection receptacle and second ejection receptacle based at least in part on the at least one pill characteristics associated with the analyzed pill, and wherein the second ejection device is configured to selectively eject an analyzed pill determined to be associated with an unacceptable pill characteristic.

2. The apparatus according to claim 1, wherein the first ejection device is configured to be in communication with the pill apertures at an angular position of the rotary drum so as to selectively eject one or more of the pills from the corresponding pill apertures outwardly of the radially outward portion, and the second ejection device is configured to be in communication with the pill apertures at an angular position of the rotary drum spaced from the first ejection device so as to selectively eject one or more of the pills from the corresponding pill apertures outwardly of the radially outward portion, and wherein the inspection devices is disposed at an angular position being rotationally upstream from both the first and second ejection devices.

3. The apparatus according to claim 1, wherein the first ejection device is configured to selectively eject an analyzed pill determined to be associated with an acceptable pill characteristic.

4. The apparatus according to claim 3, wherein a pill is associated with the acceptable pill characteristic based at least in part on a determination by the apparatus that the pill comprises an unbroken pill characteristic, and wherein a pill is associated with the unacceptable pill characteristic based on a determination by the apparatus that the pill comprises a broken pill characteristic.

5. The apparatus according to claim 1, wherein the first ejection comprises a collection mechanism, the collection mechanism being configured to collect the pills ejected by the first ejection device and to direct the pills toward a single one of a series of containers for deposition therein.

6. The apparatus according to claim 1, wherein the second ejection receptacle comprises a reject container, the reject container being configured to collect at least a pill ejected by the second ejection device.

7. The apparatus according to claim 1, wherein the rotary drum is configured such that the plurality of pill apertures is arranged in a plurality of rows about the radially outward portion thereof.

8. The apparatus according to claim 1, wherein the negative pressure system is configured to simultaneously apply a negative pressure to the plurality of pill apertures located at least between the inspection device and both of the at least first and second ejection devices so as to retain the pills therein, as the rotary drum rotates about the first axis.

9. The apparatus according to claim 1, wherein each of the at least first and second ejection devices is in communication with at least one of the plurality of pill apertures about a respective angular position and configured to receive positively pressurized air and to selectively emit the air to the pill apertures of the rotary drum at the respective angular position, the air being emitted at a positive pressure capable of overcoming the negative pressure retaining the pills within the plurality of pill apertures, so as to selectively eject one or more of the pills from the corresponding pill apertures toward one of the at least first and second ejection receptacles disposed about the respective angular position corresponding to a respective one of the at least first and second ejection devices.

10. The apparatus of claim 1, further comprising at least one counting device, wherein both the at least one counting device and the at least one inspection device are configured to count a number of pills ejected from the at least first and second ejection devices so as to verify that the number of pills ejected from the at least first and second ejection devices matches the predetermined amount of pills to be selectively deposited into the one or more containers.

11. The apparatus of claim 10, wherein the apparatus is further configured to count a number of pills ejected from the first ejection device comprising an acceptable pill characteristic and a number of pills ejected from the second ejection device comprising an unacceptable pill characteristic.

12. The apparatus according to claim 1, wherein the first axis is substantially horizontally disposed, and wherein the apparatus is further configured to deliver a selected amount of pills to at least one container via the first ejection receptacle, the at least one container being moved into coincidence with the first ejection receptacle by a conveying device.

13. A method for selectively depositing a predetermined amount of pills into each of a series of containers based on one or more pill characteristics, comprising:

receiving a pill in at least one pill aperture of a plurality of pill apertures defined by a radially outward portion of a rotary drum configured as a cylinder rotatable in a rotational direction about a first axis extending longitudinally therethrough, each of the plurality of pill apertures being configured to receive a pill from a plurality of pills disposed adjacent to the radially outward portion of the rotary drum;

applying a negative pressure to the plurality of pill apertures with a negative pressure system operably engaged with a radially inward portion of the rotary drum and in fluid communication with the plurality of pill apertures so as to retain each of the at least one pills respectively within the at least one pill apertures as the rotary drum rotates about the first axis;

analyzing each of the at least one pills respectively within the at least one pill apertures to determine one or both of the presence of a pill within a pill aperture and at least one pill characteristic associated with the pill;

selectively ejecting a pill of the at least one pills from a corresponding pill aperture of the rotary drum based at least in part on one or more pill characteristics associated with the at least one pill, the at least one pill being ejected outwardly of the radially outward portion by at least one of at least a first ejection device and a second ejection device positioned rotationally downstream from the first ejection device, the at least one of the at least first ejection device and second ejection device being operably engaged with the radially inward portion of the rotary drum and configured to be in communication with at least one of the pill apertures about a respective angular position;

collecting the pills ejected from the plurality of pill apertures of the rotary drum with at least one of at least a first ejection receptacle and a second ejection receptacle configured to direct the pills toward one or more containers of the series of containers for deposition therein;

wherein the second ejection device is configured to selectively eject an analyzed pill determined to be associated with an unacceptable pill characteristic; and determining at least a portion of an amount of pills ejected by each of the at least first ejection device and second ejection device.

14. The method according to claim 13, wherein selectively ejecting a pill of the at least one pills from a corresponding pill aperture based at least in part on one or more pill characteristics associated with the at least one pill comprises:

selectively ejecting a pill determined to comprise a first pill characteristic from a corresponding pill aperture outwardly of a radially outward portion at an angular position about the rotary drum by the first ejection device, the first ejection device configured to be in communication with the pill apertures about the respective angular position;

selectively ejecting a pill determined to comprise a second pill characteristic from a corresponding pill aperture outwardly of the radially outward portion at an angular position about the rotary drum with the second ejection device, wherein the second pill characteristic comprises the unacceptable pill characteristic, the second ejection device configured to be in communication with the pill apertures at the respective angular position; and wherein pills comprising the first pill characteristic are ejected by the first ejection device and pills comprising the second pill characteristic are ejected by the second ejection device.

15. The method according to claim 14, wherein the first pill characteristic is an acceptable pill characteristic.

16. The method according to claim 15, wherein the first ejection receptacle configured to direct the pills toward one or more containers of the series of containers for deposition therein is configured to receive one or more pills selectively ejected by the first ejection device.

17. The method according to claim 15, wherein a pill is associated with the acceptable pill characteristic based at least in part on a determination by the apparatus that the pill comprises an unbroken pill characteristic, and wherein a pill is associated with the unacceptable pill characteristic based on a determination by the apparatus that the pill comprises a broken pill characteristic.

18. The method according to claim 14 wherein receiving a pill in at least one pill aperture of the plurality of pill apertures comprises receiving at least one pill in a plurality of pill apertures defined in a plurality of rows along a radially outward portion of the rotary drum.

19. The method according to claim 14 wherein applying a negative pressure to the plurality of pill apertures further comprises simultaneously applying a negative pressure to the plurality of plurality of pill apertures with the negative pressure system located at least between an inspection device and both the first and second ejection devices, wherein the inspection device is disposed upstream from both the first and second ejection devices.

20. The method according to claim 14 wherein selectively ejecting a pill of the at least one pills from a corresponding pill aperture comprises receiving positively pressurized air at an ejection device in communication with at least one of the pill apertures about a respective angular position, and selectively emitting the air to at least one of the pill apertures at the respective angular position, the air being emitted at a positive pressure capable of overcoming the negative pressure retaining the pills within the plurality of pill apertures, so as to selectively eject one or more of the pills from the corresponding pill aperture toward one of the at least first and second ejection receptacles disposed about the respective angular position corresponding to a respective one of the at least first and second ejection devices.

* * * * *